US007150155B2

(12) United States Patent
Faber

(10) Patent No.: US 7,150,155 B2
(45) Date of Patent: Dec. 19, 2006

(54) BEVERAGE DISPENSER

(76) Inventor: Walter G. Faber, 33 Mulberry St. Unit 4, Concord, NH (US) 03301

( * ) Notice: Subject to any disclaimer, the term of this patent is extended or adjusted under 35 U.S.C. 154(b) by 0 days.

(21) Appl. No.: 10/982,948

(22) Filed: Nov. 6, 2004

(65) Prior Publication Data

US 2005/0061007 A1 Mar. 24, 2005

Related U.S. Application Data

(63) Continuation of application No. PCT/US03/14365, filed on May 6, 2003.

(60) Provisional application No. 60/380,152, filed on May 6, 2002.

(51) Int. Cl.
*F25D 13/06* (2006.01)
*F25D 25/02* (2006.01)
*F25D 11/02* (2006.01)

(52) U.S. Cl. ..... 62/63; 62/381; 62/441

(58) Field of Classification Search ..... 62/63, 62/381, 440, 441
See application file for complete search history.

(56) References Cited

U.S. PATENT DOCUMENTS 2,021,096 A * 11/1935 Canton ..... 62/377
2,247,575 A * 7/1941 De Stefani ..... 62/381
2,376,561 A 5/1945 Smith
2,376,682 A 5/1945 Gerlich
2,496,304 A * 2/1950 Muffly ..... 62/201
2,529,470 A 11/1950 Johnson
2,599,173 A * 6/1952 Hamilton ..... 194/246
2,656,688 A * 10/1953 Hinkel ..... 62/441
2,826,471 A 3/1958 Fonda
3,805,964 A * 4/1974 Titus, Jr. ..... 211/59.2
4,109,984 A * 8/1978 Gandara ..... 312/236
4,368,622 A * 1/1983 Brooks ..... 62/157
4,368,625 A * 1/1983 Platt ..... 62/378
4,586,347 A * 5/1986 McCarty ..... 62/265
4,899,904 A 2/1990 Dooley et al.
5,247,798 A 9/1993 Collard, Jr.
5,396,997 A 3/1995 Johnson
5,671,604 A * 9/1997 Rudick ..... 62/52.1
6,269,285 B1 * 7/2001 Mignault ..... 700/236

* cited by examiner

*Primary Examiner*—William C. Doerrler
(74) *Attorney, Agent, or Firm*—Finch & Nguyen PLLC

(57) ABSTRACT

A beverage dispenser providing access to beverage containers in a refrigerator. Containers may be accessed through the door and may be obtained without opening the door of the refrigerator. Multiple beverage container types may be supplied.

16 Claims, 9 Drawing Sheets

BEVERAGE DISPENSER

RELATED APPLICATIONS

This application is a continuation of PCT application serial number PCT/US03/14365, filed May 6, 2004 and published in English and claims benefit of U.S. patent application Ser. No. 60/380,152, filed May 6, 2002.

FIELD OF THE INVENTION

The present invention relates to a method and apparatus for providing pre-packaged beverages and specifically to a beverage dispenser for domestic use.

BACKGROUND

Refrigerators, freezers and refrigerator/freezers are routinely used worldwide in homes and commercial establishments for chilling and preserving food and beverages. Often, cans and bottles of beverages, including soft drinks and alcoholic beverages are placed in a refrigerator prior to consumption for chilling or to maintain a cold temperature. Typically, these cans and bottles are placed loosely on shelves in the refrigerator where they may be accessed by opening the door of the refrigerator. The beverages may be placed individually, in cartons or in serving racks that facilitate the serving of one beverage at a time.

Individuals, and particularly families, may access the refrigerator dozens of times per day in order to obtain a chilled beverage or to supplement the supply of beverages in the refrigerator. While typically being perceived as convenient, this practice requires the opening and closing of the refrigerator door many times per day. This may result in energy usage and wear and tear on the refrigerator that would not result absent the frequent accessing of the refrigerator for beverages. A typical beverage vending machine may provide access to a single chilled beverage without opening a refrigerator door, but requires, among other things, payment for dispensing, is difficult to load and is not typically convenient for use in households as it is expensive and does not alleviate the need for a conventional refrigerator/freezer in the home.

SUMMARY OF THE INVENTION

In one aspect an apparatus is provided comprising a freezer compartment, a refrigerator compartment, a refrigerator door having an interior and an exterior, and a passage connecting the exterior to the interior wherein the passage is arranged and configured to receive beverage containers.

In another aspect, an apparatus is provided comprising a refrigerator, a beverage container holder secured to the interior of a door of the refrigerator and means for obtaining a beverage container without opening the door and without reaching through the door of the refrigerator.

In another aspect, an apparatus is provided comprising a rack dimensioned to hold a plurality of beverage containers, and a refrigerator comprising a door, the door comprising an opening between the interior and the exterior of the refrigerator, the opening sized to allow passage of at least one beverage container through the refrigerator door and configured to secure the rack.

In another aspect, a device is provided comprising a rack configured to hold a plurality of beverage containers, the rack adapted to be affixed to a refrigerator door and associated with a passage in the refrigerator door, the passage joining an interior of the refrigerator with an exterior of the refrigerator.

DESCRIPTION OF THE DRAWINGS

Non-limiting embodiments of the invention will be described by way of example with reference to the accompanying drawings. Not all embodiments are illustrated and not all components are shown. Common reference numbers between figures represent similar parts performing similar function although they may not be identical.

DETAILED DESCRIPTION

Figure 1A:
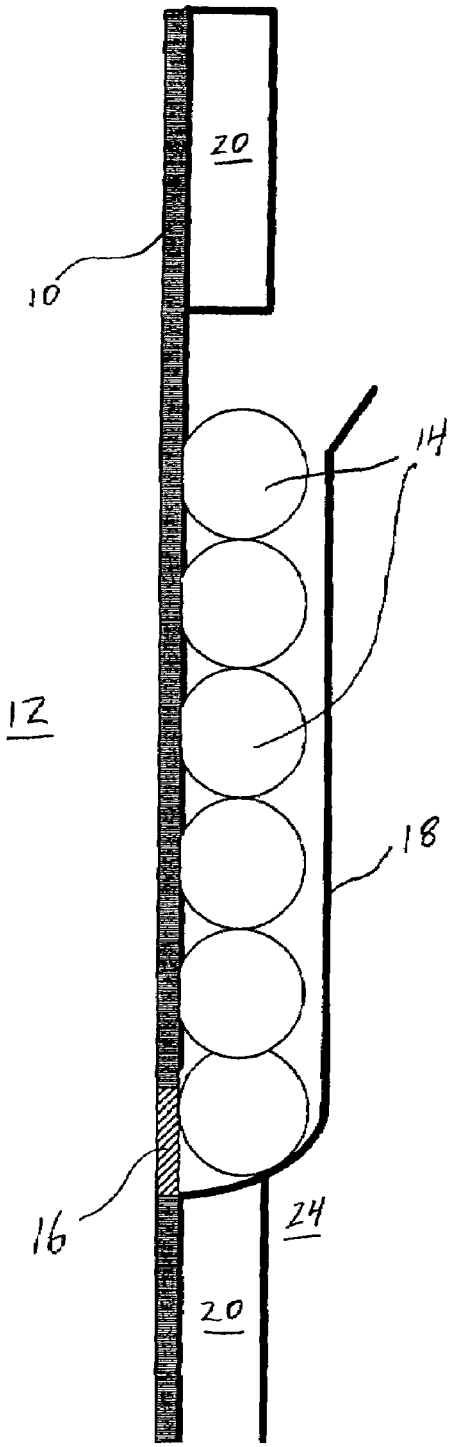
FIGS. 1*a* and 1*b* provide a cutaway side view of a beverage dispenser in a refrigerator door.

A method and apparatus for supplying chilled beverages from a refrigerator are provided. Beverages may be supplied with minimal intrusion into the refrigerator resulting in, for example, energy and time savings, as well as a reduction in wear and tear on the refrigerator door and on the refrigerator compressor.

In one embodiment, the device may be incorporated into a user-accessible door on a refrigerator or refrigerator/freezer that is normally used in a home. Although some refrigerators may not include freezer sections, most do and, as used herein, a "refrigerator" is an appliance that includes both a freezer section and a refrigerator section. The refrigerator may be accessible for routine tasks as are most home refrigerators today. This is in contrast to a vending machine that may not be user accessible and may require payment in order to receive a beverage. Thus, in one embodiment, a "through-the-door" beverage dispensing system is provided that can be incorporated into a typical household refrigerator while still being used for storage of foodstuffs and other items traditionally stored in refrigerators. In addition, the device may be used as part of a combination refrigerator/freezer as opposed to a vending machine which is typically a stand-alone device. Furthermore, as the beverage containers may be removed from the refrigerator without first dropping them to a receiving area (as with vending machines), the beverages, particularly carbonated ones, may be less disturbed when received by the user. In some embodiments the device may be incorporated into the door of a refrigerator/freezer.

In one embodiment, a refrigerator/freezer is provided that, other than the device for providing beverages, may be similar or identical to the over/under or side-by-side refrigerator freezers that are commonly seen in homes of today. However, the refrigerator door may include a passage that allows for the removal of beverages from the chilled area of the refrigerator to an area external of the refrigerator. The passage may be associated with a holding mechanism that is associated with a rack for storing one or more beverage containers. For example, the holding mechanism may hold six, twelve or 24 beverage containers. The beverage containers may be chilled by the refrigerator and may be isolated from the exterior by a divider, such as a sliding door or flexible polymeric sheet. By moving the divider, a user may be able to access a beverage by pulling on a partially exposed can or, in another embodiment, cans may be automatically fed into position for easy removal once the divider is moved by the user. Beverages may be loaded into the holding mechanism through the passage but preferably are loaded in bulk by opening the door of the refrigerator and placing multiple beverage containers into the holding mechanism. The containers may feed the passage from the top, from below or from either side. Preferably, beverage containers are placed in the holder using a last in/last out system whereby the first containers to be dispensed from the refrigerator are those that have resided in the refrigerator the longest and thus are likely to be the coldest. In one embodiment, a common twelve-pack carton may be directly inserted into the rack, without a need to remove the associated cardboard carton.

In one embodiment, the passage through the refrigerator door is sized to allow a container to pass through horizontally with the container being in line with the surface of the refrigerator door. Alternatively, the container may pass through a smaller opening that may be circular, in which the long dimension of the container is oriented front to back of the refrigerator. While this latter technique may allow for some advantages, such as a smaller opening and a greater number of dispensers per door, it also may have some disadvantages, such as making extraction of the can from the passage more difficult.

In another embodiment, the passage is at a height that is convenient for beverage consumers. If permitting access to only some is undesirable, for example if children are to be excluded from access, the opening may be positioned higher so that a more childproof dispenser can be used. A single appliance may include two or more dispensers that may be located at different heights or different horizontal positions in the refrigerator door.

In another embodiment, the dispenser is not located in the door of the refrigerator-but instead is located on the side of the appliance. This may only be appropriate in some refrigerator installations but may be desirable if placement in the door is inappropriate. For example, a side location for the device might allow for extensive horizontal loading of beverage containers within the refrigerator, such as on a conventional refrigerator rack or shelf. The containers may be fed to the side-placed device by applying a horizontal force to containers stored in a horizontal manner. A single shelf in the refrigerator might be dedicated to supplying beverages to the dispenser, while the other shelves and the door of the appliance could be conventional.

The holder may be shaped to hold any number of containers and it is preferred that the holder be supported entirely by the door of the refrigerator if the dispenser is mounted on the door. In the case of a side-mount unit, the dispenser may be supported by the side structure itself or by shelves in the interior of the refrigerator. In the case of a door-mounted unit, the interior of the refrigerator, for example, the shelves may be reconfigured to allow for additional space to hold beverage containers when the door is closed. The number of containers may be limited by the structure of the door and its associated hinges, but modern refrigerator doors are typically engineered to hold significant weight, such as gallons or half gallons of milk.

In some embodiments, such as those in which an over/under freezer and refrigerator arrangement is used, it may be preferred that the containers are stored below the passage exit through the door, as the passage may be most preferably placed near the top portion of the refrigerator door. In this embodiment, and others, a force may be provided to push the containers upward toward the passage and may feed the containers to the passage when a previous container has been removed. Such a force may be provided by, for example, a spring (either compressed or extended, depending on the arrangement), a motor, a piston, a magnet or a compressed or pressurized fluid. The force should be of a magnitude to sufficiently move a full contingent of beverage containers, yet should not be so strong as to push containers through the passage prior to the user initiating the removal of a container. In addition, the force should preferably not be so great as to pinch fingers or cause other inconvenience to users who are removing or loading containers. The force may be variable and may be dependent on the weight of containers contained in the device at any one time. A controller may be used to adjust the force in response to a change in the number of containers held in the unit.

In other embodiments, for example, those in which there is room to hold containers in a position above the passage exit through the door, gravity may be used to supply the force to feed containers to and through the passage. For instance, a stack of cans or bottles above the passage may supply enough weight to push the cans or bottles through the opening when a release is initiated by the user. In some instances, it may be preferable to damp this force, such as by constricting the passage, providing a tortuous path for the containers to follow or supplying a force in opposition to gravity (such as those mentioned above).

In one embodiment, the passage includes a divider, such as a sliding door, separating the stored beverages from the exterior of the refrigerator. The sliding door may be opaque or, alternatively, transparent, in order to allow a container to be seen and therefore identified without moving the sliding door. The sliding door may be single, double or multiple-walled in order to provide, for example, an insulative effect between the compartment holding the chilled beverage and the warmer exterior of the refrigerator.

In one embodiment, the user may initiate the release of a beverage container. For example, movement of a sliding door or activation of a switch or other mechanism may provide for release of a beverage. Alternatively, the beverage container may be retained in position by a device that can be overcome by the user grabbing the container and supplying an opposing force. This device may comprise, for example, a flexible ring or rectangular-shaped frame that is normally sized slightly smaller than the dimension of the container that it is meant to retain. When the user tries to pull the container through the passage, the flexible piece is stretched, or expanded, allowing the container to pass through. Once the container is through the expanded piece, the piece returns to its original shape and size and retains the succeeding container. The frame may be shaped to allow fingers to pass through in order to obtain a grip on the container. For example, a rectangular frame may have a shaped (e.g., semi-circular) cut-out on one or both ends or sides in order to provide finger access for gripping the container. In an alternative embodiment the area is made of a softer, pliable material rather than a cut-out. The pliable material may be easily moved when a user reaches to grab a container. Other devices may include clips, springs or levers that maintain the container in position. In one embodiment, moveable pieces supply pressure to one or each of the indented ends of a can and thus hold the can in place until it is pulled out by a user.

Figure 1B:
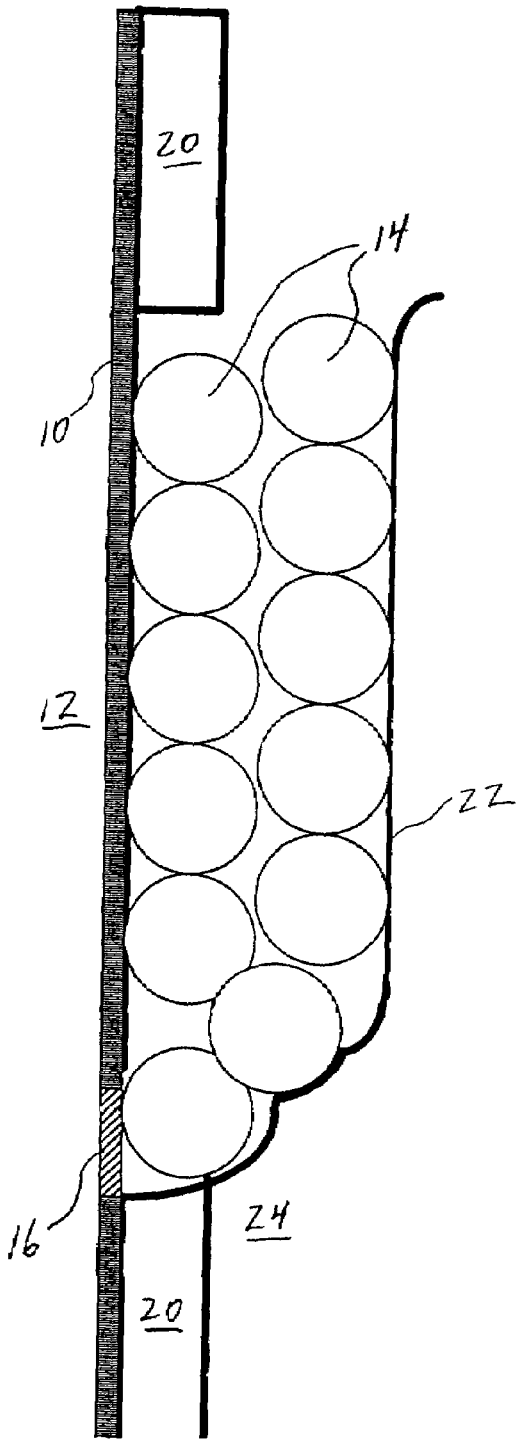

FIGS. 1*a* and 1*b* illustrate two embodiments of the invention designed to hold six and twelve containers, such as cans, respectively. Each figure shows a cross section of a refrigerator door with a rack attached to the interior of the door. Rack 18 is designed to hold six cans 14 in a single column of horizontally stacked cans. A second and/or third and/or fourth rack of the same type may be positioned next to rack 18 as shown. Racks may also be positioned above or below each other. Either the top or the bottom of the cans may be facing the viewer, as illustrated. Passage 16 provides communication between the interior 24 of the refrigerator and the exterior 12. Door 10 may be insulated and additional insulation 20 may be used above and below the rack. Passage 16 may be of a generally rectangular shape when viewed from the front of the refrigerator. The passage may be slightly larger than the dimensions of a 12 oz beverage can and may include a cover (not shown) to minimize heat intrusion into the refrigerator. FIG. 1*b* is similar in design except that it is deeper to hold twice as many cans. The lower section of rack 22 is convoluted to provide one can at a time to passage 16. As in FIG. 1*a*, multiple racks may be employed with a single refrigerator. Both racks in FIGS. 1*a* and 1*b* may be easily loaded from the top meaning that containers near the bottom, or outlet, will generally have been refrigerated longest and thus may be the coldest. Warm cans placed in the top will often be cold by the time they are accessed through passage 16. Passage 16 is configured so that one may withdraw a container from the rack without reaching into the refrigerator.

Figure 2:
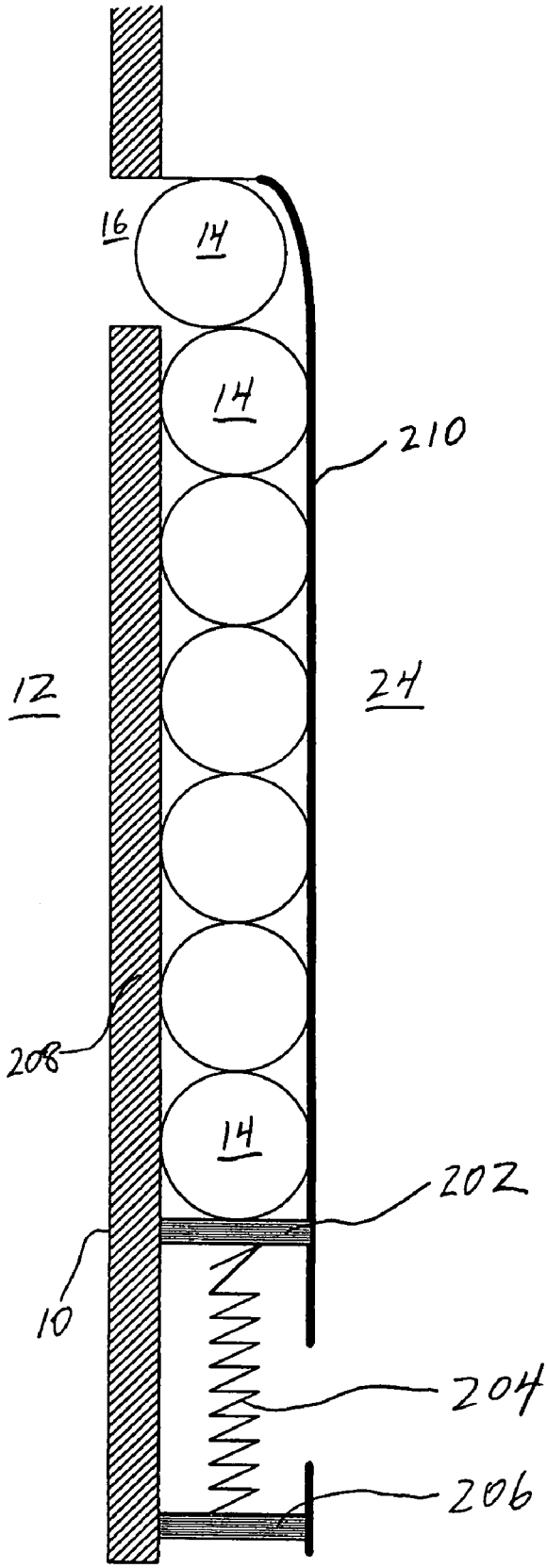
FIG. 2 provides a cutaway side view of an embodiment of the invention in which a spring provides an upward force to a stack of beverage containers.

FIG. 2 illustrates a different embodiment in which containers are fed from the bottom of the rack 210 to a passage 16 positioned at the upper end of the rack. Spring 204 supplies a force to push piston 202 upwardly to move the cans toward the passage 16. Base 206 supports the spring. The spring may be a piston, cylinder, elastomer or any other device capable of providing an upward force to the stack of cans. Door 10 is insulated by insulation 208 separating the interior 24 from the exterior 12 of the refrigerator. Preferably, spring 204 is chosen so that its expansion force decreases with extension so that the same amount of force is applied to the top can regardless of how many cans are in the rack. For example, if three fewer cans were in the rack than as shown, the force supplied by the spring would be decreased by the weight of three cans when extended at the higher position. In this manner, passage 16 and any frame or retaining device around the passage can be designed to perform with a constant force pushing the can through the passage regardless of how full the rack is. Piston 202 may be associated with a meter (not shown) readable inside and/or outside of the refrigerator. The position of piston 202 translates directly into how many containers remain in the rack. Thus, a meter associated with the piston can provide information as to how many containers are loaded in the rack.

Figure 3:
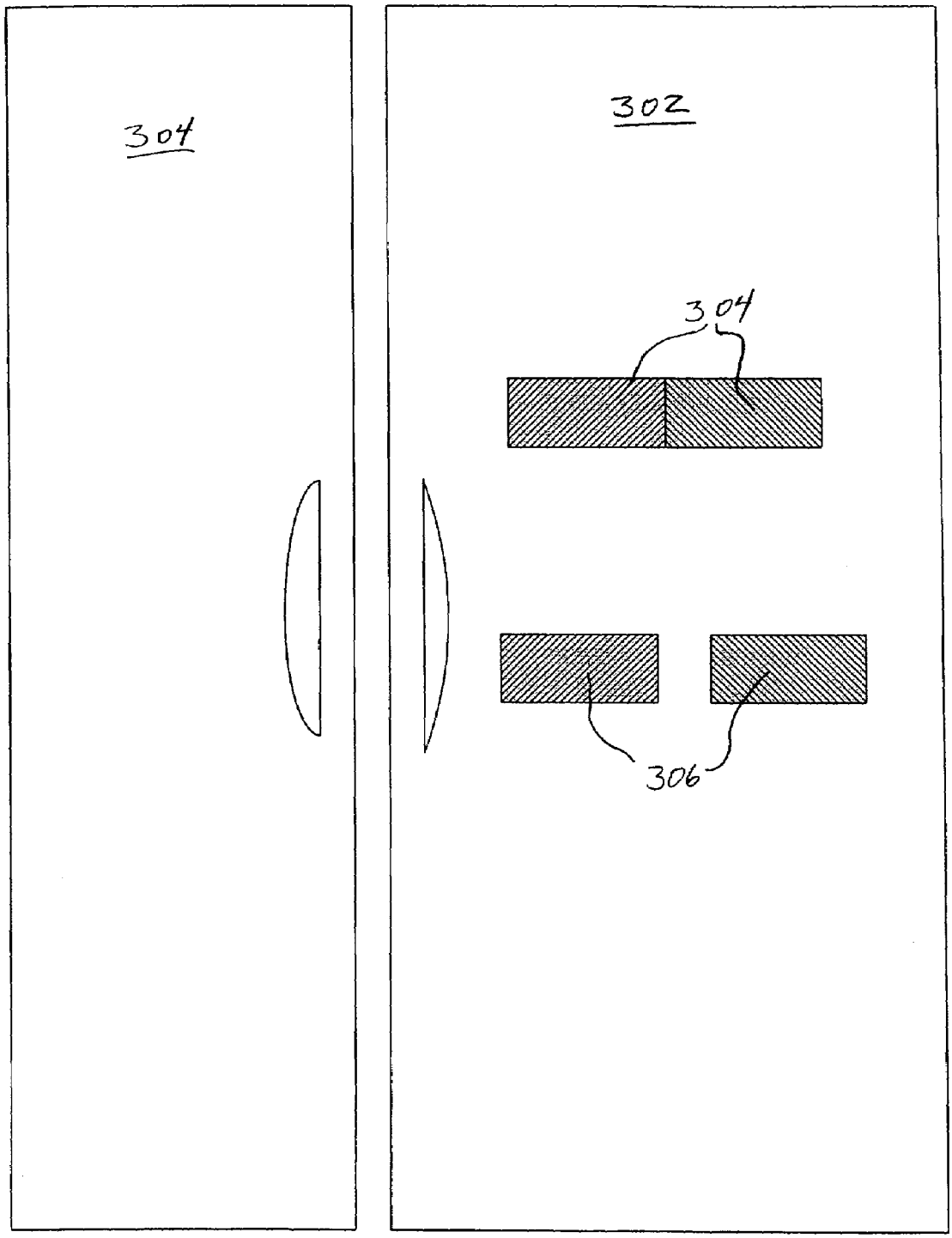
FIG. 3 provides a frontal view of a side-by-side domestic refrigerator/freezer showing two options for placement of beverage container outlets.

FIG. 3 provides a frontal view of a side-by-side refrigerator including a beverage dispenser. Passages 304 are adjacent each other and may be stocked with similar or different beverages. Passages 306 are at the same level but are not adjacent each other and may hold similar or different beverages. In many embodiments, on one or two passages such as either 304 or 306 are used.

Figure 4:
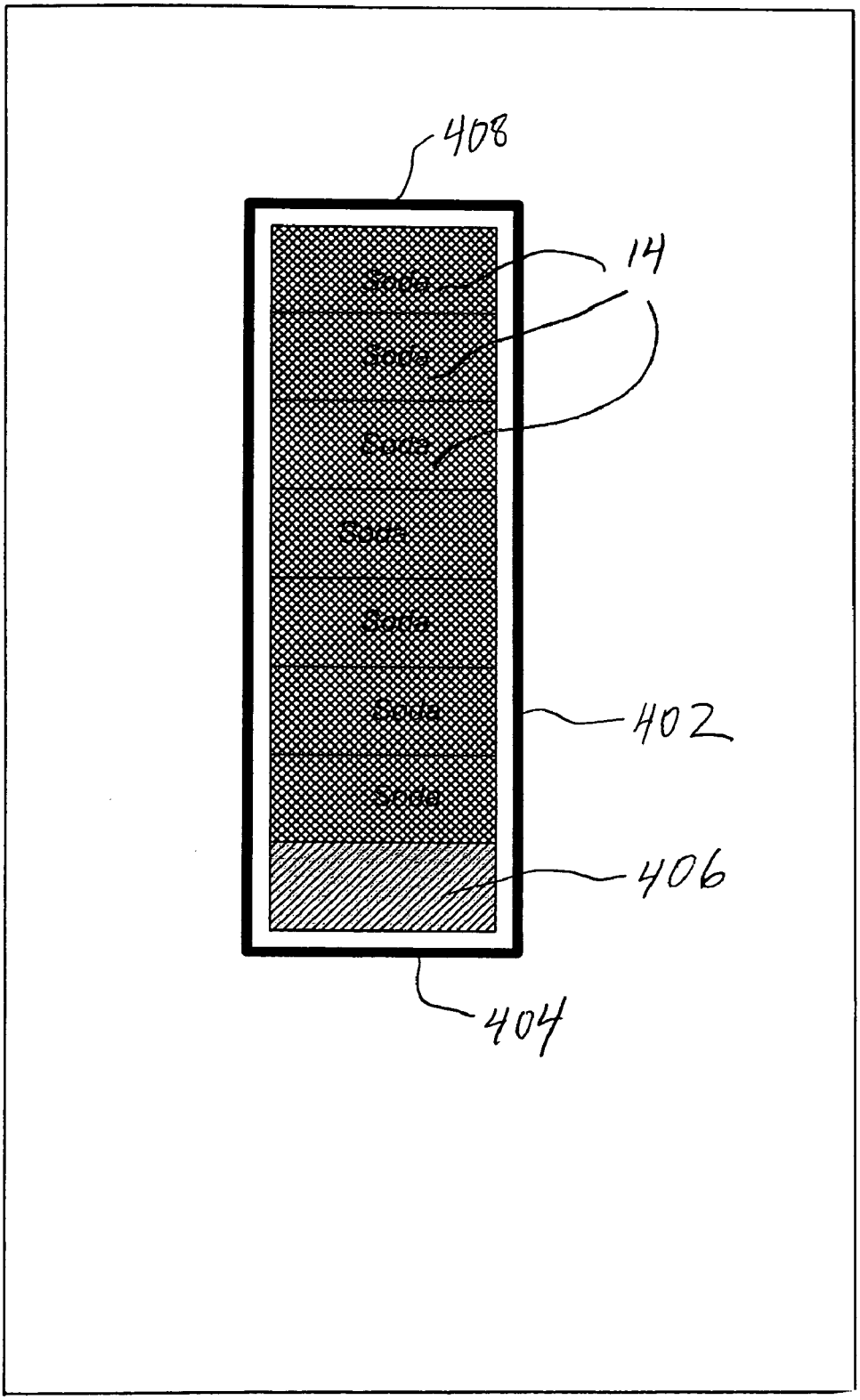
FIG. 4 provides a rear view of the door of a refrigerator incorporating one embodiment of the invention that uses a stack of horizontally oriented beverage cans.

FIG. 4 provides a view from the back of a refrigerator door and shows a stack of containers 14 retained by rack sides 402 and rack base 404. Shaded area overlapping the cans represents the rear portion of the rack that may or may not be transparent. Passage 406 provides an outlet for cans to be removed from the front of the door. Cans may be most easily loaded from top 408 which may be a movable or removable door or, alternatively, may just be open.

Figure 5:
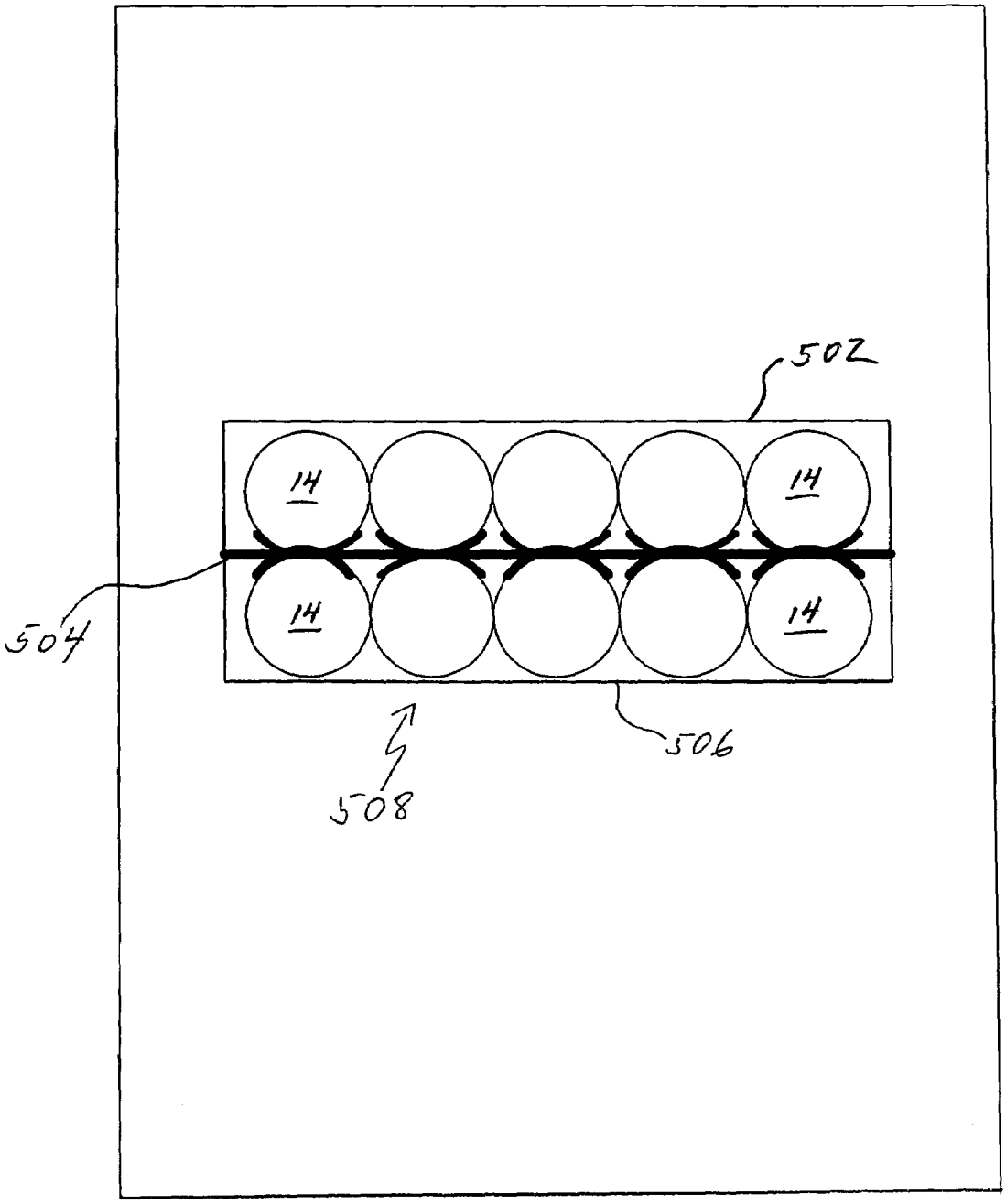
FIG. 5 provides a front view of a refrigerator door showing an embodiment of the invention in which ten horizontally stacked cans are accessible through an outlet in the door.

FIG. 5 illustrates an embodiment where 10 beverages, that may be the same or different, may be accessed from the exterior of the refrigerator independently. This view is from the front of a refrigerator door and the dispenser 508 may or may not be visible as it may be covered with an opaque, translucent or transparent cover to maintain cold within the refrigerator. Divider 504 keeps containers organized and stops them from rolling once an adjacent can has been removed. Cans can be withdrawn through the door by grasping a can individually and pulling it toward the user.

Figure 6:
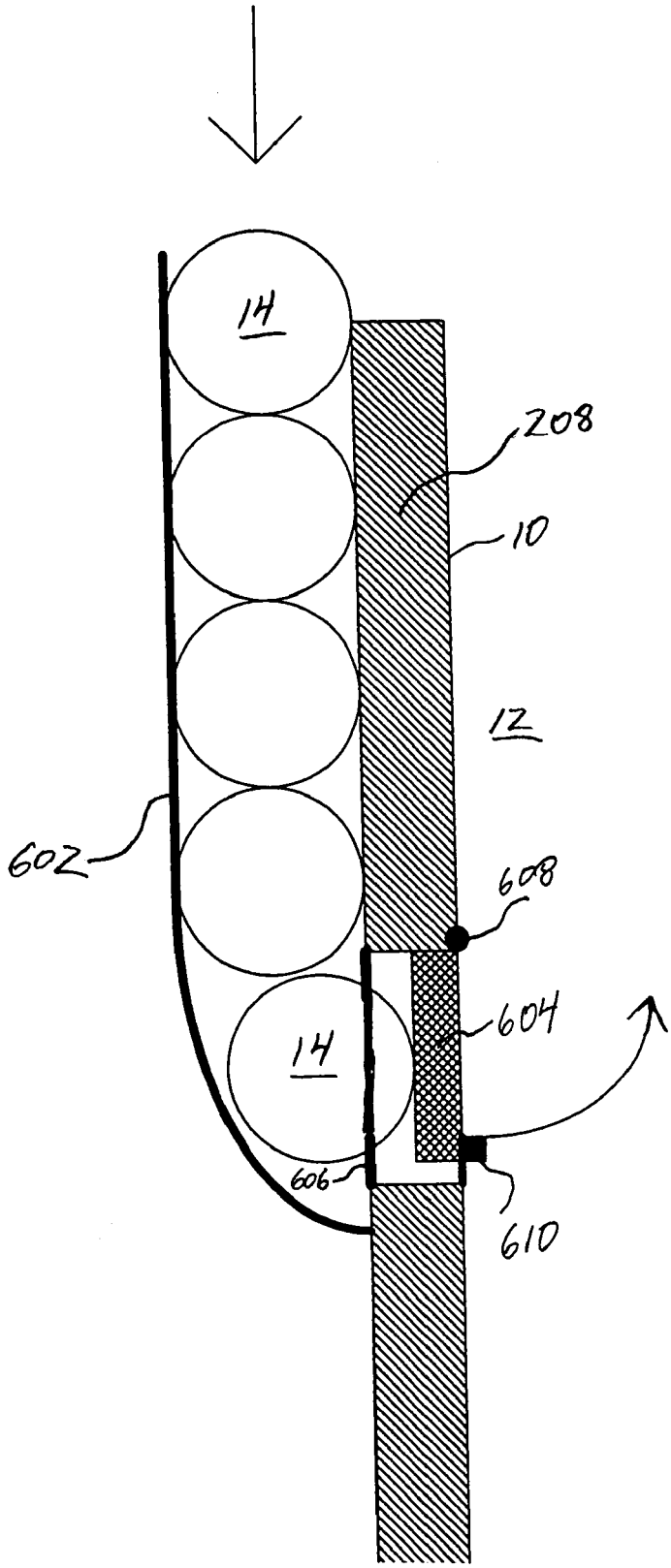
FIG. 6 provides a cutaway side view of an embodiment of the invention including a hinged insulated door covering the outlet.

FIG. 6 illustrates a side view of another embodiment in which gravity provides the force moving containers to the passage. Alternatively, the device may be flipped over and a force, such as by a spring, may be provided to push the containers toward the passage. Passage door 604 is hinged at 608 and may be secured by latch 610 which may be a magnetic or other easily removable latch. Lowest can 14 has passed part way through frame 606 but has been stopped because frame 606 provides an opening slightly smaller than the container. The length from left to right of the frame (looking from the front of the refrigerator) may be slightly larger or equivalent to the length of the container, but preferably the height of the frame is less than the diameter of the container. Frame 606 provides a gasket for additional insulation between the interior and exterior of the refrigerator. When door 604 is lifted up, the container may be grasped at opposing ends in the area shown to the right of frame 606. The container may then be pulled through pliable frame 606. Frame 606 may be made of any material, preferably a pliable material such as rubber, PVC, foam or urethane. After removal of the container, frame 606, in combination with the curvature of rack 602, may prevent the next container from exiting the passage. Door 604 may then be returned to its original location and latched in place.

Figure 7:
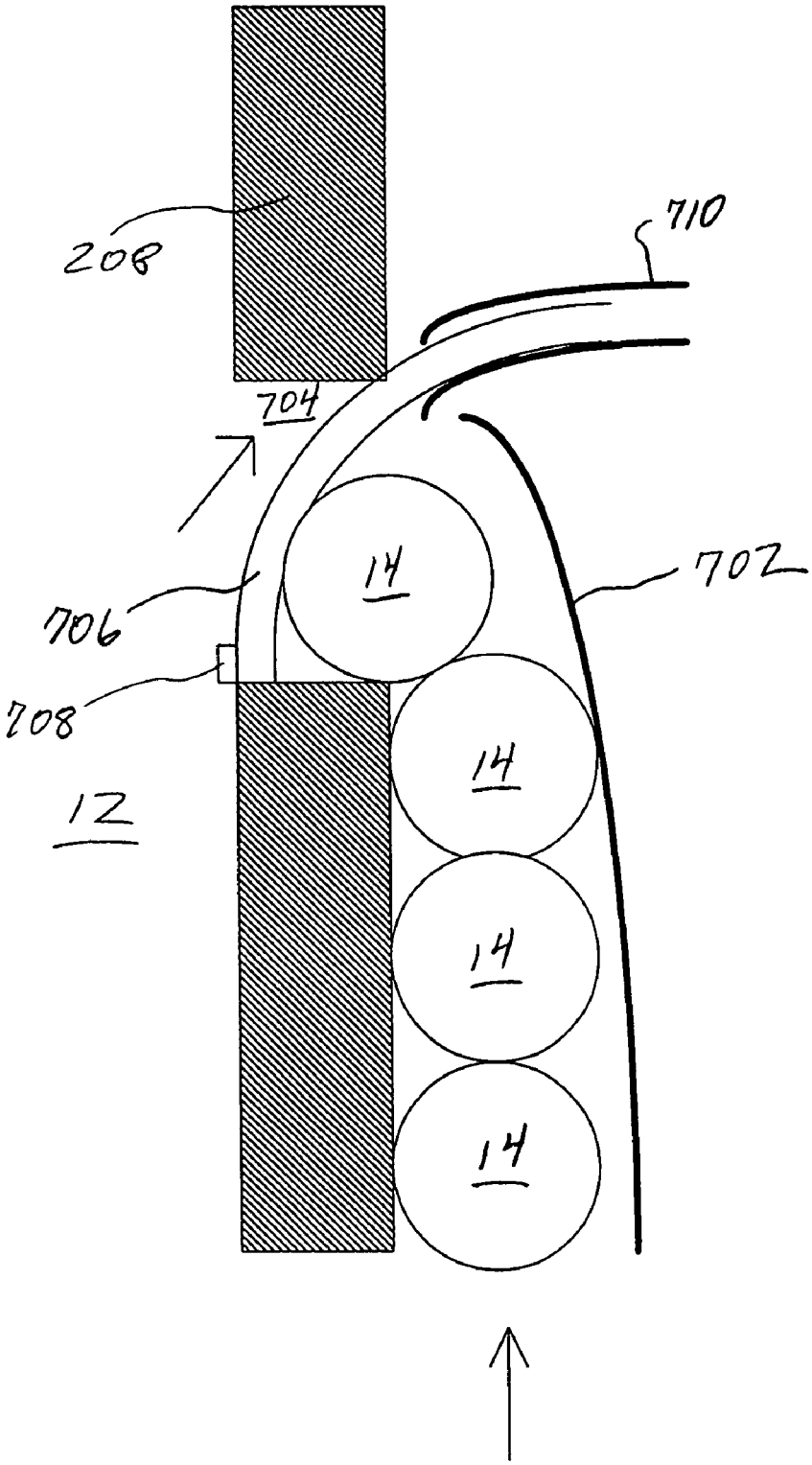
FIG. 7 provides a cutaway side view of the invention in which a force is applied to a stack of containers from below and a curved, sliding door retains the top can.

FIG. 7 illustrates an embodiment of the invention where rack 702 is attached to door 208 and works in conjunction with curved sliding door 706 that may be transparent or opaque. Knob 708 allows the door 706 to be grasped and moved upwardly to slide into receiver 710. Containers are then freed and may be accessed through passage 704. Door 706 may be of insulative material to minimize cold loss from the refrigerator. The rack 702, door 706 and receiver 710 may all be designed so they are integral to the refrigerator door. Rack 702 may include an optional door (not shown) to be used for loading containers from the rear of the device.

Figure 8A:
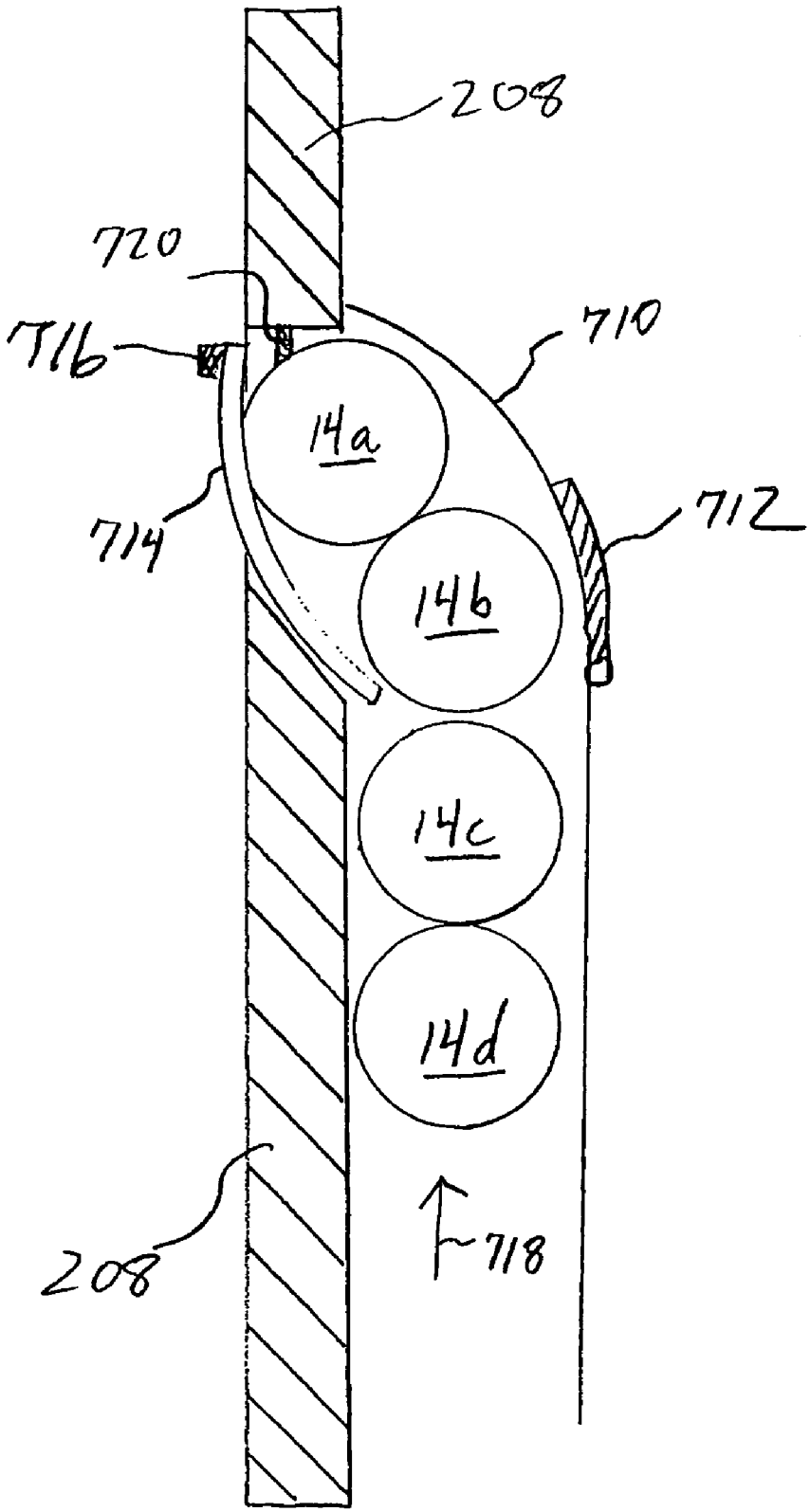
FIG. 8*a* provides a cutaway side view of an embodiment in which a curved sliding door protects the containers and slides downward to release the top can and prevent release of the second can.
Figure 8B:
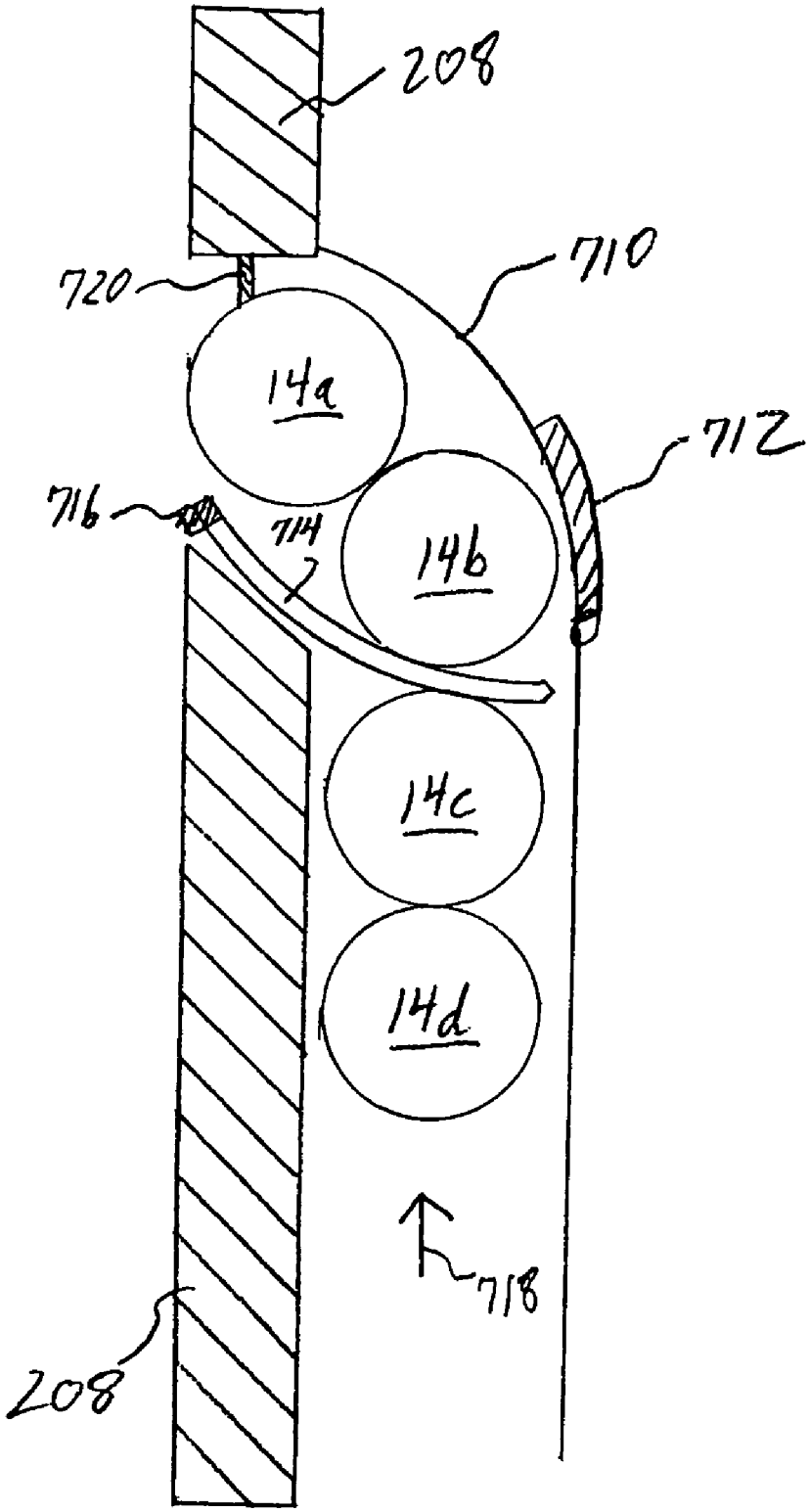
FIG. 8*b* provides a cutaway side view of the embodiment shown in FIG. 8*a* with the curved door having moved to an open position with the first container available to the user and the second container protected from the upward force provided through the container below.

FIGS. 8*a* and 8*b* illustrate two different positions of the same device. In FIG. 8*a* the dispenser is closed and container 14*a* is kept secure behind slidable door 714. Gasket 720 helps in securing the can and in improving insulation capabilities of the device. Rack 710 is attached to refrigerator door 208 and a spring or other device provides force 718 to move the containers upward. Rear door 712 provides access to the rack for loading cans into the dispenser. By grasping handle 716 and moving sliding door 714 downward, the position of the device is changed to that shown in FIG. 8*b*. In FIG. 8*b*, container 14*a* is exposed to the exterior of the refrigerator and can be removed my grasping and pulling past gasket 720. At the same time, door 714 has divided containers 14*b* and 14*c* and is preventing the force of spring 718 from being transferred to container 14*b*. As a result, can 14*b* stays in position due to gravity and is not advance from the dispenser. After container 14*a* is removed from the dispenser, door 714 may be moved upwardly resulting in the removal of the door from the area between containers 14*b* and 14*c*. As a result, the upwardly force is renewed at container 14*b* and 14*b* advances to the position that formerly held container 14*a*. This procedure may be repeated until all containers have been removed.

Further modifications and equivalents of the invention herein disclosed will occur to persons skilled in the art using no more than routine experimentation, and all such modifications and equivalents are believed to be within the spirit and scope of the invention as defined by the following claims.

What is claimed is:

1. An apparatus comprising:

a freezer compartment;

a refrigerator compartment having an interior and an exterior;

a refrigerator door having an exterior surface, the door permitting access to the interior of the refrigerator compartment; and a passage connecting the exterior of the refrigerator compartment to the interior of the refrigerator compartment wherein the passage is dimensioned to admit not more than one beverage container at a time, the passage having dimensions of less than about 9 inches by 6 inches when passing through the exterior surface of the door.

2. The apparatus of claim 1 wherein beverage containers are accessible without opening the refrigerator door.

3. The apparatus of claim 1 wherein the beverage containers are cans.

4. The apparatus of claim 1 comprising a rack for holding at least 6 containers.

5. The apparatus of claim 1 comprising a rack for holding at least 12 containers.

6. The apparatus of claim 4 wherein the rack is affixed to the refrigerator door.

7. The apparatus of claim 1 wherein the passage has dimensions of less than about 8 inches by 5 inches at the exterior surface of the door.

8. The apparatus of claim 1 further comprising a passage door covering the passage.

9. The apparatus of claim 8 wherein the passage door is hinged.

10. The apparatus of claim 8 wherein the passage door slides.

11. The apparatus of claim 8 wherein the passage door is transparent or translucent.

12. The apparatus of claim 1 further comprising a spring whereby the spring provides a force to move containers toward the passage.

13. The apparatus of claim 1 wherein gravity provides a force to move containers toward the passage.

14. The apparatus of claim 1 further comprising a second passage connecting the exterior of the refrigerator compartment to the interior of the refrigerator compartment wherein the passage is arranged and configured to receive beverage containers.

15. The apparatus of claim 1 further comprising a flexible frame mounted in the passage and configured to retain container in position until and added force is provided by a user.

16. An apparatus comprising:

a freezer compartment;

a refrigerator compartment having an interior and an exterior;

a refrigerator door permitting access to the interior of the refrigerator compartment;

a passage connecting the exterior of the refrigerator compartment to the interior of the refrigerator compartment wherein the passage is dimensioned to admit not more than one beverage container at a time; and a flexible frame mounted in the passage and configured to retain a container in position until an added force is provided by a user.

* * * * *